US007507062B2

(12) United States Patent
Pasty

(10) Patent No.: US 7,507,062 B2
(45) Date of Patent: Mar. 24, 2009

(54) CONTAINER FOR STORAGE AND TRANSPORTING OF A RADOME

(75) Inventor: Jean-Luc Pasty, Nozay (FR)

(73) Assignee: Societe Air France, Roissy-Charles-de-Gaulle (FR)

( * ) Notice: Subject to any disclaimer, the term of this patent is extended or adjusted under 35 U.S.C. 154(b) by 482 days.

(21) Appl. No.: 11/442,984

(22) Filed: May 31, 2006

(65) Prior Publication Data

US 2006/0284011 A1 Dec. 21, 2006

(30) Foreign Application Priority Data

May 31, 2005 (EP) ..... 05360021

(51) Int. Cl.
*B60P 7/08* (2006.01)

(52) U.S. Cl. ..... 410/46; 410/43; 410/87; 410/156

(58) Field of Classification Search ..... 410/2, 410/35, 43, 44, 46, 87, 88, 155, 156; 220/1.5, 220/213, 252, 324, 669; 206/386, 521, 524, 206/523; 108/57.25, 57.34, 55.1, 55.3, 57.16, 108/57.12
See application file for complete search history.

(56) References Cited

U.S. PATENT DOCUMENTS 6,824,338 B2 * 11/2004 Looker ..... 410/67

* cited by examiner

*Primary Examiner*—Stephen Gordon
(74) *Attorney, Agent, or Firm*—Oliff & Berridge, PLC

(57) ABSTRACT

A Container for the storage and transportation a radome displays a flat base on which the flat wall of said radome rests and a detachable lid that can be immobilized on the periphery of the base. The base consists of a plate of rectangular shape, two of whose diagonally opposite corners are truncated. The cover has a peripheral lower wall of vertical configuration whose outline conforms to the contour of the base and an upper wall curving inward near the top of the radome, the peripheral lower and upper walls being connected on each face corresponding to a side of the rectangle by at least one sloping side curving inward in the immediate proximity of the radome.

30 Claims, 4 Drawing Sheets

CONTAINER FOR STORAGE AND TRANSPORTING OF A RADOME

The present invention concerns a container for storing and transporting a radome, i.e. the dielectric cupola transparent to electromagnetic waves that forms the nose of an airplane and is intended to protect the antenna of the radar apparatus.

This radome, which is made of Kevlar or, more recently, of quartz, is relatively fragile and may be damaged in flight due to weather and more specifically by hail or lightning or, for instance, as a result of collision with birds.

On the ground also, the radomes may be damaged during maintenance of the plane, in particular as a result of shocks (being struck by a ladder, etc.), which may occur during the inspection of the antenna.

The airlines owning fleets of aircrafts, therefore, have a certain number in stock in order to carry out repair operations in the shortest possible time in the event of incidents requiring the removal and replacement of radomes. When a problem occurs or is detected at an airport in which the company has maintenance units equipped with such spare parts, the replacement of a damaged radome is a well-managed operation that can basically be carried out quite rapidly.

The situation is different when a radome has to be replaced at the site of a stopover which has no replacement unit(s) in good condition, since it will then be necessary to send at least one to the site. The shipping of such an element poses problems, especially as regards its space requirements, because a radome essentially has the shape of a cupola or dome approximately one meter tall and almost two meters in diameter at its base, which is not a negligible volume to be conveyed under these particular conditions, considering its fragile character.

The builder of the aircraft, AIRBUS in the example constituting the thread of the present invention, delivers the radomes in parallepipedic boxes whose height is close to one meter fifty [cm] on the sides with a length a little more than two meters, in other words a volume much greater that that of the radome itself.

Until the present these cases/boxes have been transported by road to the extent that the stopover site permits it, or by air. In the latter case the boxes mentioned above are not designed to be housed in the cargo bays of medium-sized carriers, e.g., of the A320 series; it is necessary to resort to large cargo planes which, if required, must deviate from their normal route in order to deliver to the stopover sites in question.

None of these solutions is considered satisfactory due to the complexity of organization that they entail and the resulting unfavorable economic effects. The transportation times also suffer from the need to organize specific transportation procedures when a problem occurs in the absence of codified procedures that cannot be implemented. Finally, the oversize volume of the crates in which the radomes are delivered and transported, on these assumptions, would significantly increase the freight.

Since most stopovers are serviced by medium-sized planes which perform regular or frequent rotations, transportation by these aircraft could be a suitable response to the problem posed and additionally be much simpler and faster to implement than the existing solutions, and finally, it could perceptibly reduce the maintenance costs per operation. This is especially true since the volume of the radomes is compatible with that of the luggage compartments of mid-size planes of the A320 family and especially of AIRBUS A319, A320 and A321 although just barely in the transverse dimension.

Considering the fragile character of the radome, therefore, it is impossible to place it in the luggage bay without protection, and it is therefore advisable to provide a container especially intended for transporting it. Such a container should also comply with numerous technical requirements, the chief of which is a pure volume criterion since it should only occupy a space slightly greater than the radome itself in order to be housed in the cargo bays of the above-mentioned aircraft; it should be able to pass freely through the hatch of said cargo bays/luggage compartments, which excludes the AIRBUS A318, and finally should keep the freight costs as low as possible. In three dimensional terms the container should also conform to the shape of said compartments and permit the operations of handling for the purpose of loading and removing it without harming the walls of the compartment or those of the containers.

The present invention satisfies these objectives by proposing a container that permits the easily implemented transportation of a radome under economically favorable conditions, especially in the rear compartments of planes of the AIRBUS 320 series, which are planes widely used in the medium-haul national and international network.

In the absence of solutions proposed by the aircraft manufacturer, the objective of the invention is to assure that any problem involving the shipping of a radome over these distances can be simply solved by using an airplane that ordinarily stops at the airports where the damaged equipment is located, which in fact considerably simplifies the routing operation for the maintenance crew.

The container according to the invention, for this purpose, has a flat base on which the flat wall of the radome rests and a removable cover that can be affixed to the periphery of the base, and it is essentially characterized in that:

- the base consists of a plate of rectangular shape, two of whose diagonally opposite corners are truncated;
- the cover has a peripheral lower wall running vertically whose outline conforms to the contour of the base and an upper wall located near the top of the radome, the peripheral lower and upper walls being connected, on each face corresponding to a side of the rectangle, by at least one sloping facet curving inward in the immediate proximity of the radome.

The existence of truncated diagonally opposing corners of the base, generating diagonally opposing and parallel cut sides in the cover, is justified by the need to preserve a space for the decompression trap door, which opens upon the opening of the handle of the compartment door. This decompression trapdoor has the sole purpose of decompressing the compartment in order to avoid accidents when the door is opened. It is protected by a cap whose volume extends into the interior of the compartment, hence the necessity of leaving a space near the container according to the invention.

The existence of two diagonally opposite cut sides also permits the immediate recognition of the two orientations that may be given to the container for its positioning in the compartment. Finally, they serve as de facto positioning guides for mounting the cover on the base.

The walls curve inward according to a prismatic geometry permitting them to impart a certain rigidity to the assembly, on the one hand, and positioning them near the radome, on the other, in order to reduce the space required and simultaneously to improve the degree of protection.

More precisely, the cover displays on at least two opposing faces a single sloping facet connecting the lower peripheral wall to the upper wall.

Although it is not technically necessary to resort to flat faces, the latter permit one to obtain a crate having the correct rigidity at a reasonable production cost, because the prismatic volume is simple to fabricate.

Preferably, and for reasons also resulting from the particular shape of the radome to be packaged, the cover displays a single sloping facet for two opposing faces, linking the lower peripheral wall to the upper wall and for the other two faces, two facets oriented at an angle of inclination respectively diminishing in the direction of the upper wall.

The volume of the radome does not, in fact, have an exact symmetry of revolution but rather can be described as a hemisphere of slightly ovoid shape whose base is also truncated along a sloping facet to which the brackets for fixation to the aircraft are attached. These brackets are involuted into the volume of said hemisphere, and the radome may therefore be placed flat on the base.

Besides the sloping facets, which are flat for the reasons mentioned above, the container according to the invention displays an upper wall, also flat, for better adaptation to the configuration of the compartments. In the AIRBUS A319, A320 and A321 the compartment is effectively separated from the floor of the passenger compartment by a thick partition whose lower face, i.e. the ceiling of the compartment, is flat.

The base of the container is provided with supporting studs on its lower face opposite that on which the radome rests. In other words, when the container of the invention is resting on the ground, it is resting there on these supporting studs. The extra elevation that the latter provide is intended to conform to the specific geometry of the compartments. On the lower part of the side walls they display sloping facets which reduce the width of the compartment as it approaches the floor and, in the lower parts of these walls, the width of the compartment is no longer sufficient to accept the base of the container (not to mention the flat base of the radome).

Since these sloping facets are slanted toward the top it was necessary to provide a means for raising the base. This is one of the reasons for the existence of the above-noted supporting studs, which therefore participate in the adaptation of the configuration of the container to the specific geometry of the compartments. These studs, more precisely, permit a rise of the order of 14 cm and additionally make movement of the container according to the invention inside the compartment possible and allow it to preserve a few centimeters between its upper wall and the ceiling.

They preferably consist of blocks of parallelepiped shape divided into two rows arranged in parallel along and close to the two sides of the base.

In this configuration, besides their lifting function, the supports may serve as guides for mounting the container of the invention on the rectangular pallets that can only be used in the compartments of the A320 and A321. For the A319 the crate is loaded as it is on the floor and held by a separating net usually arranged between the different storage sections.

The pallets in question are those that are traditionally used for transporting and handling luggage and packages that are stored there using straps and nets. The same applies to the container of the invention that is attached to the pallet with four straps, assuring its retention in flight.

At least the studs arranged near the corners are additionally provided with means of fixation to the pallet. More precisely, said means of fixation may consist of an angle iron, one side of which is plated and affixed, e.g., by screwing, to the stud, the second side perpendicular to the preceding one being directed toward the periphery of the base, i.e. toward the outside in the direction of the fixation rails provided on the pallet.

The crate is then secured by simply clamping said angle irons to their studs, resulting in a corresponding clamping of the second side in the rails arranged on the periphery of the pallet. In practice this appears in the form of a rectangular frame surrounding the supporting studs whose arrangement is such that the corner studs are fitted into the corners of said frame, hence their use as guide pins for mounting the container on the pallet.

The base of the container of the invention has got a downward chamfer on at least the two opposite edges corresponding to the sides of the container to be oriented parallel to the axis of the compartment. This is necessary in order for the container not to collide with the sloping side faces forming the lower contour of the compartments, considering the height given to the supporting studs, which is kept to a minimum in order to leave a few centimeters between the upper wall of the cover and the ceiling of the compartment.

The slope of the chamfer also preferably corresponds to that of the lower sloping sides of the compartments, toward which they extend.

To improve the sliding and consequently the handling of the containers of the invention in the compartments it is also envisioned that the chamfered edges are lined with a protective film or layer of synthetic material with a low coefficient of friction, such as the material sold under the trademark Teflon. This coating also avoids possible damage to the walls of the compartments during the handling of the container.

The radome is not simply placed on the base before being covered with the cover. In order to secure it in its packaging it is envisioned that the container of the invention will have means of chocking and immobilizing which prevent or reduce the relative movements, absorb shocks, etc.

The means of chocking, in particular, consist of two chocks arranged tangentially to the base of the radome, the means of immobilizing consisting of two flanges to which the bracket arms for immobilizing the radome to the plane are attached.

More precisely, these flanges are each composed of two similar vertical plates of parallel configuration connected by a shaft parallel to the base, permitting the same type of pivoting attachment as between the radome and the upper part of the nose of the aircraft.

The chocks on the one hand, and the fixation flanges on the other, are situated respectively near the two opposite sides of the container and form an isoceles trapezoid. The chocks are preferably of an absorbent material and have the shape of an L, constituting a seat and backrest, at the juncture of which the periphery of the radome is pressed when the holding brackets are fastened to the fixation means. These chocks are aligned in such a way as to permit, in collaboration with the fixation couplings, the horizontal blocking of the radome in all directions.

At least two internal faces of the cover are additionally lined with tapes or bands of flexible and absorbent material of the foam type, which absorbs the potentially destructive effects of shocks applied to the radome while nullifying or reducing the possibilities of relative movements of the cover and radome.

Finally, the radome is held inside the container of the invention in such a way that it cannot or only slightly move relative to the envelope provided by the container. Internal shocks caused by relative displacements of one relative to the other are practically impossible, and external shocks are well absorbed.

According to an additional possibility, the cover may display at least one opening permitting the operators to observe directly whether the container of the invention has indeed been provided with a radome at the time of packing. It will preferably have two of them, situated on the two opposite sloping sides.

The cover is solidly affixed to the base, for example, with the aid of spring clips locks distributed around the circumference of the container of the invention. These closing devices, which are very easy to operate, permit the operations of closing and opening to be performed very quickly and without tools.

Preferably, in order not to damage the side walls of the compartment and not to impede the sliding of the container when it is being loaded into the compartment, considering the small possible cross clearance, these spring clips locks are accomodated in notches in the base having such a depth that they do not extend outside of them. This possibility exists, at least, on the sides of the containers that are parallel to the axis of the compartment, i.e. sides that face the side walls.

According to one possibility, the container displays two spring clip closures per face.

According to an additional characteristic, which has considerable importance in the organization of the packing procedure, one of the walls of the cover is provided on its outside surface with a record holder intended to contain the documents required for performing the maintenance according to the established rules and in the absence of which the radome cannot be replaced.

To facilitate the handling of the container the lower side walls of vertical appearance of the cover may be equipped with handles. The latter are then installed to rotate freely in a hinge mounted against the wall of the cover in such a way as they flatten against said wall under the influence of their own weight.

For the purpose of centering and positioning the cover on the base, the latter is equipped with a peripheral barrier wall around its contour serving as a reference mark and support during the seating of the cover.

Even more preferably, the cover is made of a composite material chosen, among other reasons, for its mechanical characteristics, especially resistance and rigidity combined with low weight.

The base may be made, for example, of laminated wood.

The assembly will then have a weight of the order of 210 kg in the absence of a pallet and of the order of 252 kg when the container is attached to a pallet.

The container of the invention will now be described in more detail with references to the attached figures, of which:

Figure 1:
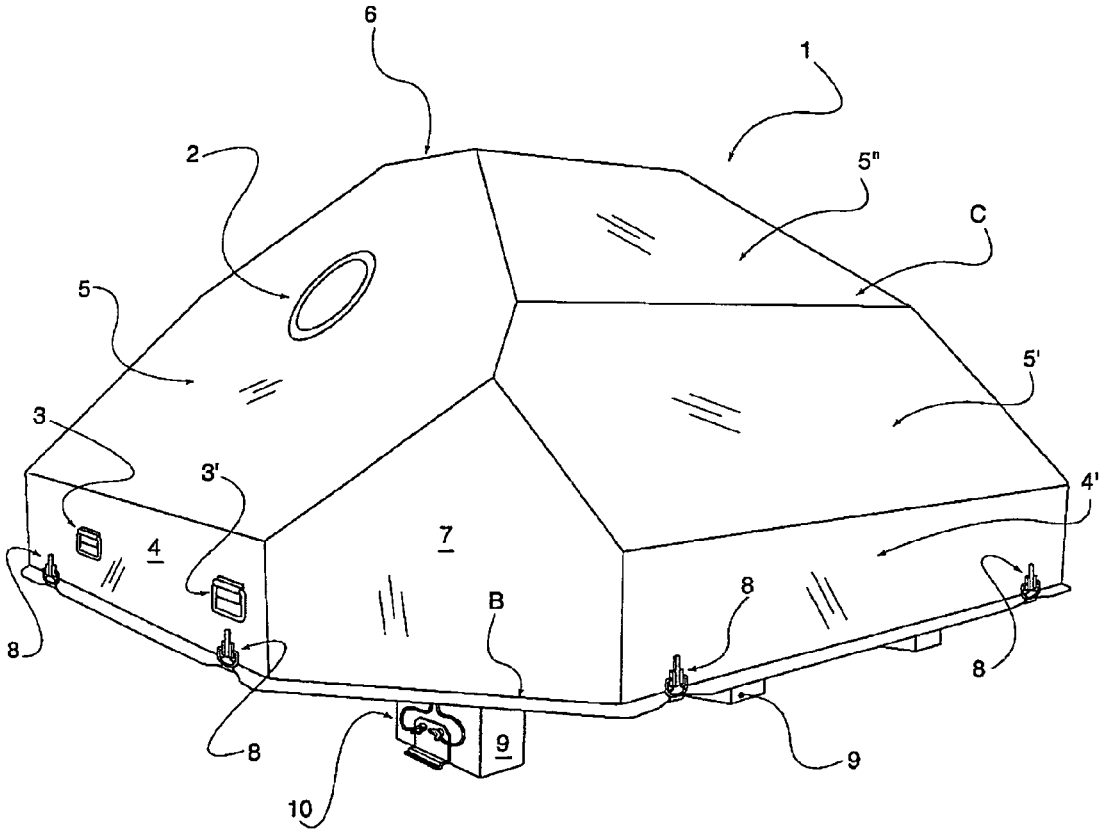
FIG. 1 is a perspective view of a container according to the invention

FIG. 1 shows two sides of the container (1) of the invention, which is sufficient to define it since it has double symmetry. The side with an opening (2), also provided with handles (3,3') for handling, is aligned in the direction of the axis of the airplane during its insertion into the compartment. It consists of a vertical facet (4) and a single sloping facet (5).

The transverse face shown on this figure also consists of a vertical facet (4') and two sloping flat facets (5',5") with different slope angles: the degree of sloping of the facet (5") is greater than that of facet (5').

The container (1), finally, is equipped with one flat top or summit wall (6). The two faces that can be seen on FIG. 1 are connected by a vertical cut-away facet (7) which leaves a space free for the depressurization trap door and its protective cap, which are interconnected with the door of the compartment.

Thus, the container (1) of the invention is composed of a flat base (B), to which a cover (C) can be affixed, e.g., by using spring clip/grasshopper locks (8) arranged around the circumference of the container (1) at a rate of two locks per face.

The base (B) is also equipped with supporting studs (9) arranged in two parallel transverse rows (only one of which is visible on the figure), the corner of said studs (9) being equipped with angle irons (10) for attachment to a pallet (not shown) used in the AIRBUS A320 and A321 but not in the AIRBUS A319.

Figure 2:
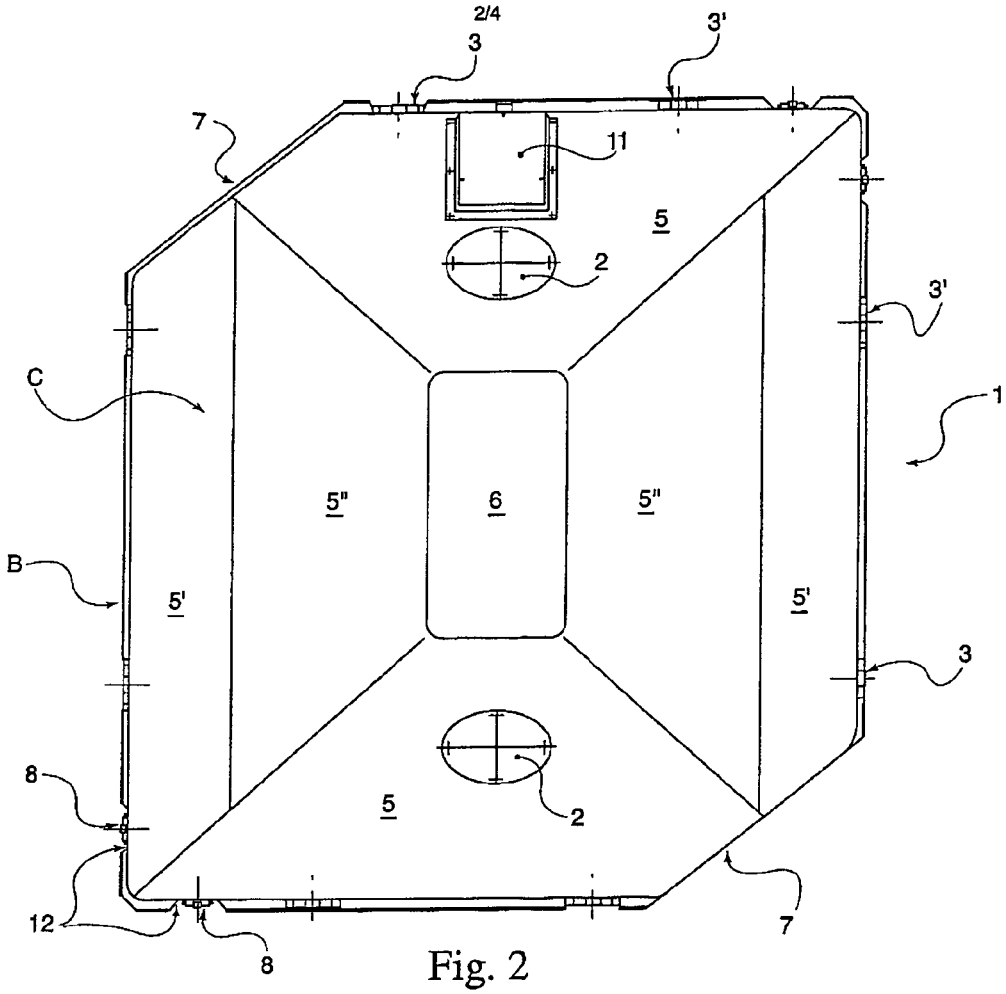
FIG. 2 is a top view of the container shown in FIG. 1.

FIG. 2 clearly illustrates the dual symmetry that characterizes the container (1) of the invention, which especially facilitates the insertion of the container (1) into the compartment due to the fact that two positions (180° from each other) are possible for its axial displacement.

According to one configuration, one of the sides (5) is equipped with a record-holder (11), made of transparent plastic, for example, and which contains, as mentioned above, the documents, without which no replacement is possible in terms of the safety standards applicable to airplanes. This record holder (11) is preferably impermeable.

The base (B) consists of a flat plate, on which the radome is fastened, it is provided with notches (12) in which the spring clip locks (8) are arranged. The depth of the notches is such that the locks (8) are nestled in them and cannot cause damage to the side walls of the compartments of the airplanes and/or impede the sliding of the containers at the time of their insertion.

Figure 3:
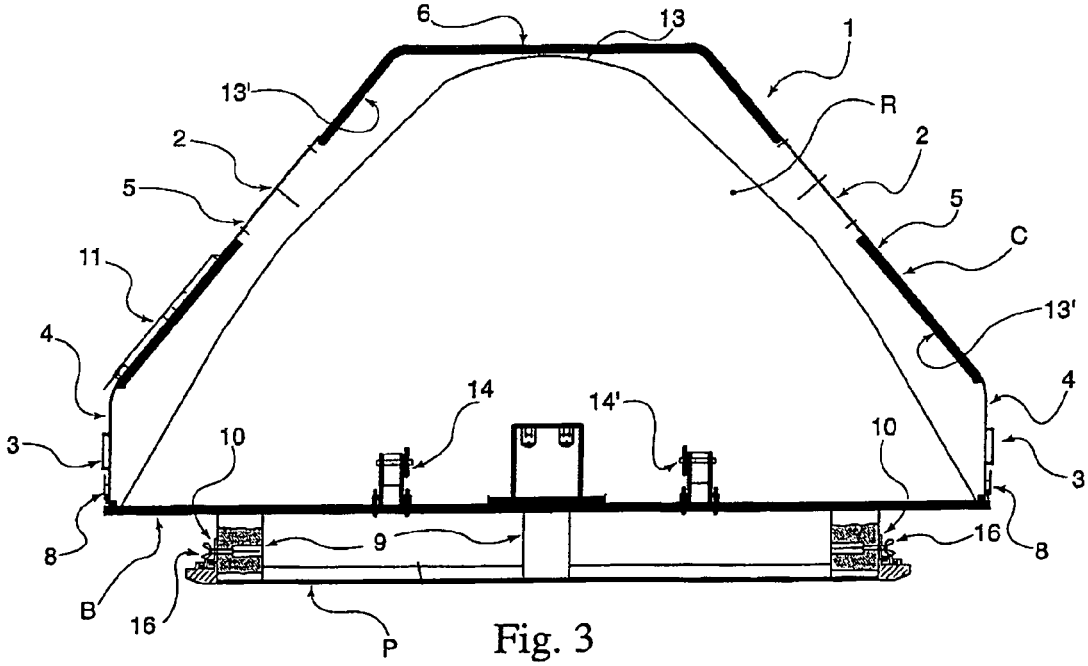
FIG. 3 shows a cross-sectional view.
Figure 4:
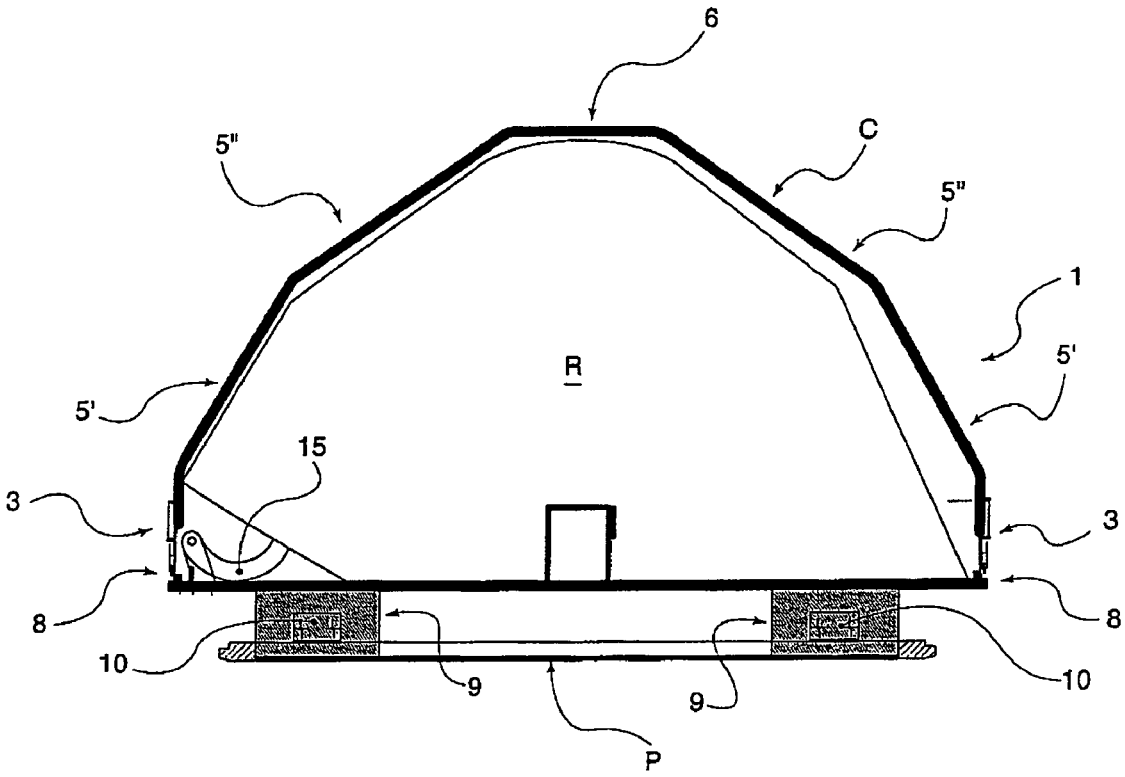
FIG. 4 is a longitudinal view of the container, i.e. parallel to the axis of the aircraft.

The section in FIG. 3 shows the volumes of the radome (R) and the cover (C), respectively. The combination of FIGS. 3 and 4 shows at which point the volume enclosed by the volume of the cover (C) is close to the exterior volume of the radome (R). The envelope of the cover (C) is constructed with flat facets assuring good rigidity of the whole while preserving a simplified geometry and consequently a reasonable production cost.

The lower face of the cover is covered with bands (13, 13') of absorbent material of the foam type to avoid shocks between the cover (C) and radome (R) to protect it against damage during transportation. Secondarily, especially in the vertical dimension, these bands (13, 13') may have a chocking or wedging effect and thereby prevent relative displacement between radome (R) and container (1).

On one side the base (B) is equipped with flanges (14, 14') provided with a horizontal shaft permitting the fixation of the hinged brackets (15) (see FIG. 4) conforming to the mode of pivoting connection identical to that employed for the attaching the radome to the airplane.

In FIGS. 3 and 4 the supporting studs (9) are shown arranged on a pallet (P) for handling. They are affixed at the level of the corner studs (9) by the angle irons (10) attached to said studs (9), e.g., by wing screws (16).

Figure 5:
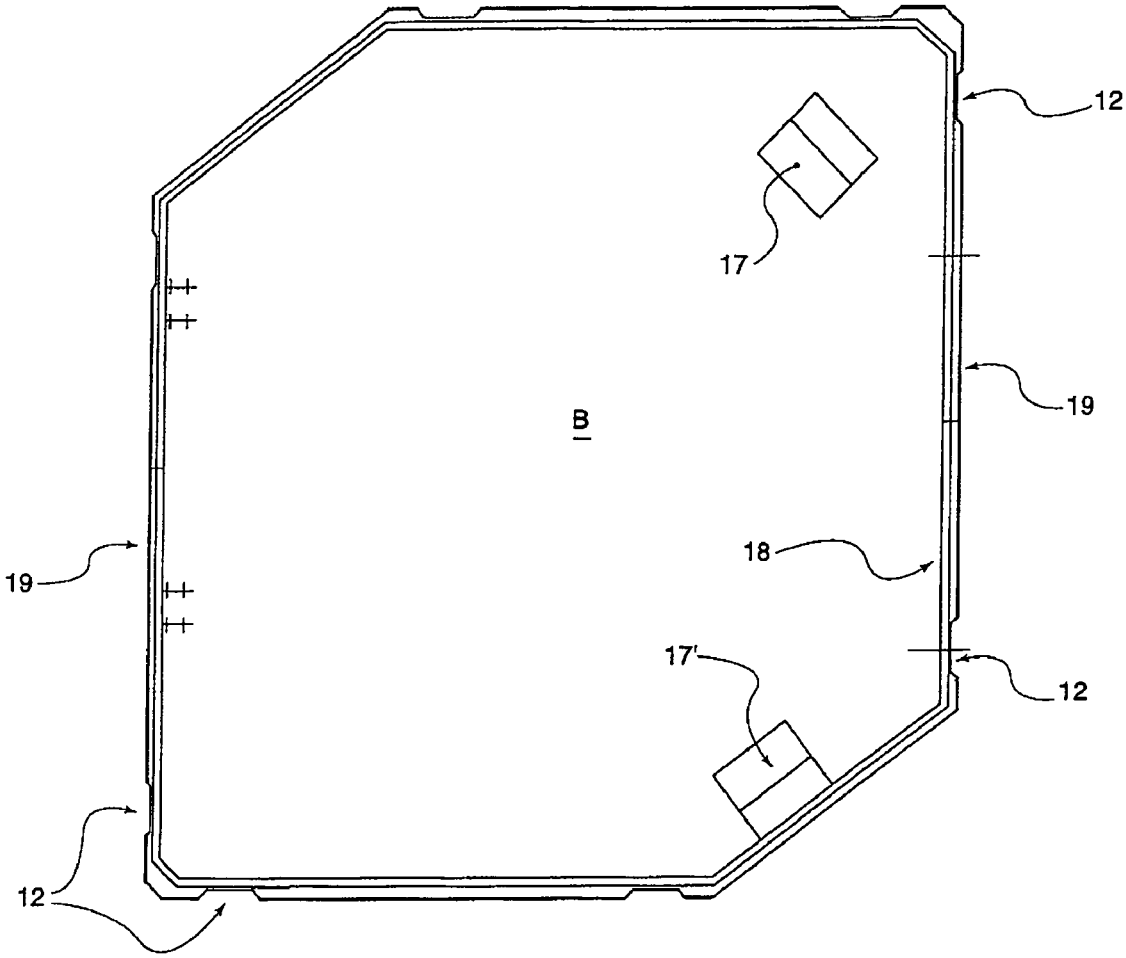
FIG. 5 is a top view of the base.

The base (B) alone appears on FIG. 5 without equipment except for the absorbent L shaped chocks (17, 17') on the horizontal part where the radome (R) rests. Their vertical part, in turn, touches the periphery of said radome (R) and assures wedging or chocking in the horizontal plane in collaboration with the flanges (14,14').

This figure also shows the notches (12) provided to accept the parts of the spring clip locks (8) interconnected with the base (B)

A low retaining wall (18) used for positioning/centering of the cover (C) skirts the outer edges of the base (B). At least the edges curving along the axis of the compartment and consequently potentially capable of coming into contact with the side walls of said compartment are lined with a material with a low coefficient of friction, e.g. that protected by the trademark TEFLON.

Figure 7:
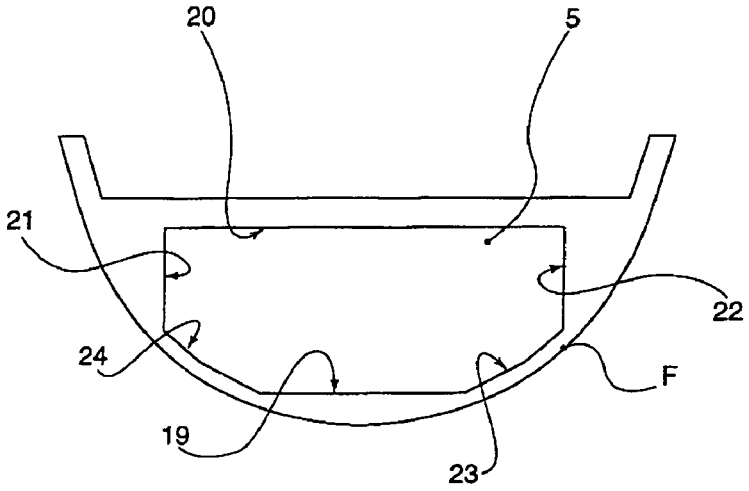
FIG. 7 is a sectional view of a luggage compartment.
Figure 6:
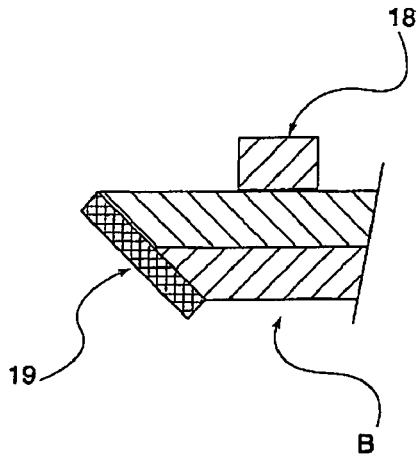
FIG. 6 is a partial section of the peripheral chamfered edge of the base.

These edges are also chamfered, as is shown more clearly on the partial section in FIG. 6, in order to conform to the sloping walls forming the lower part of the compartment (S), which is shown—in section—in FIG. 7, showing the lower part of the fuselage (F) of an AIRBUS of the A320 series.

The compartment consists of parallel horizontal floor (19) and ceiling and two vertical walls (21, 22). The latter are joined to the floor (19) via two parts (23, 24) sloping at different angles.

The chamfering of the longitudinal edge rails of the container (1) of the invention extends to the immediate proximity of the sloping facets (23) and consequently displays a slope essentially equal to that of said facets (23) to optimize the spatial compatibility of the container (1) with the compartment (S).

A description of one possible example of configuration of the container (1) of the invention has been given above. However, this example does not limit the invention, which may be extended to cover other accessories, be fabricated from different materials from those mentioned above, and undergo minor alterations in shape etc. without departing the framework of the invention. Likewise, the container (1) of the invention has the primary purpose of being used for transporting radomes in luggage compartments. However, it may also be used equally well to protect radomes in the phase of storage in the maintenance units.

The invention claimed is:

1. Container for storage and transporting a radome, displaying a flat base on which a flat wall of said radome rests and a removable cover interconnectable to a periphery of the base, wherein:

the base consists of a rectangular plate, two of whose diagonally opposing corners are truncated;

the cover has a peripheral lower wall running vertically whose outline matches a contour of the base to form faces corresponding to a side of a rectangle and a top wall located near the top of the radome, the lower peripheral walls and top wall being connected, on each face corresponding to a side of the rectangle, by at least one sloping facet curving inward in the immediate vicinity of the radome.

2. Container for storing and transporting a radome according to claim 1, wherein the cover displays on at least two opposing faces a single sloping facet connecting the lower peripheral wall with the top wall.

3. Container for storing and transporting a radome according to claim 1, wherein the cover displays on at least two opposing faces a single sloping facet connecting the lower peripheral wall with the top wall and on two other faces, two facets oriented with decreasing slope angles in a direction of the top wall.

4. Container for storing and transporting a radome according to claim 1, wherein the top wall and each sloping facet are flat.

5. Container for storing and transporting a radome according to claim 1, wherein the base is equipped with supporting studs on a face opposite a face serving to support the radome.

6. Container for storing and transporting a radome according to claim 5, wherein the supporting studs consist of blocks of parallelepiped shape divided into two parallel rows arranged along and near a two sides of the base.

7. Container for storing and transporting a radome according to claim 6, wherein at ones of the studs arranged near corners are equipped with means of attachment to a pallet for handling and transporting.

8. Container for storing and transporting a radome according to claim 7, wherein said means of attachment consist of an angle iron, one of whose facets is plated and affixed to the respective stud, a second facet running perpendicularly to the one facet and being oriented toward a periphery of the base.

9. Container for storing and transporting a radome (R) according to claim 1, characterized in that the base (B) is chamfered downward on at least two opposite edges corresponding to sides of the container (1) to be aligned parallel to an axis of a compartment.

10. Container for storing and transporting a radome according to claim 9, wherein at least the edges having chamfering are lined with a protective film of synthetic material with a low coefficient of friction.

11. Container for storing and transporting a radome according to claim 9, wherein a slope of the chamfered edges corresponds to that of the sloping sloping lower facets of walls of a compartment in whose direction they extend.

12. Container for storing and transporting a radome according to claim 1, wherein the base is equipped with chocking means and means of fixation of the radome.

13. Container for storing and transporting a radome according to claim 12, wherein the chocking means consist of two chocks arranged tangentially to a base of the radome, the means of fixation being composed of two flanges to which bracket arms provided for interlinking the radome to an airplane are attached.

14. Container for storing and transporting a radome according to claim 13, wherein the flanges are each composed of two identical vertical plates running parallel connected by a shaft parallel to a base to which one of the bracket arms for fastening the radome to the airplane is pivot-connected.

15. Container for storing and transporting a radome according to claim 13, wherein the chocks are composed of an absorbent material of a foam type and have the shape of an L with a seat and backrest, against a juncture of which a periphery of the radome is pressed when the bracket arms are fastened to the fixation means.

16. Container for storing and transporting a radome according to claim 13, wherein the chocks and the flanges are respectively located near two opposite sides of the container forming an isoceles trapezoid.

17. Container for storing and transporting a radome according to claim 1, wherein the cover has at least one porthole/opening.

18. Container for storing and transporting a radome according to claim 17, wherein the container has two openings situated on two opposite sloping facets.

19. Container for storing and transporting a radome according to claim 1, wherein the cover is interconnected to the base by means of spring clip locks distributed around a circumference of the container.

20. Container for storing and transporting a radome according to claim 19, wherein the spring clip locks are nestled in notches on the base having a depth such that the locks do not extend outside of the notches.

21. Container for storing and transporting a radome according to claim 19, wherein the container has two of said spring clip locks on each face.

22. Container for storing and transporting a radome according to claim 1, wherein at least two internal faces of the cover are lined with bands of flexible and absorbent material of the foam type.

23. Container for storing and transporting a radome according to claim 1, wherein one of the walls of the cover is equipped with a record holder on its outer surface.

24. Container for storing and transporting a radome according to claim 1, wherein the vertically running lower side wall of the cover is equipped with handles.

25. Container for storing and transporting a radome according to claim 24, wherein at least one of the handles is in free rotation on a horizontal hinge mounted against the lower wall of the cover in such a way as to be flattened against said lower wall when at rest under the effect of its own weight.

26. Container for storing and transporting a radome according to claim 1, wherein the base is equipped with a low peripheral retaining wall around its contour which is provided to facilitate the centering and positioning of the cover the base.

27. Container for storing and transporting a radome according to claim 1, wherein the cover is made of a composite material.

28. Container for storing and transporting a radome according to claim 1, wherein the base is made of laminated wood.

29. Container for storage and transporting a radome according to claim 1, wherein the container is in a luggage compartment of an airplane.

30. Container for storing and transporting a radome according to claim 8, wherein the one of the facets of the angle iron is affixed by screwing.

* * * * *